United States Patent [19]

Harrap

[11] 3,986,328

[45] Oct. 19, 1976

[54] METHOD AND APPARATUS FOR PNEUMATICALLY REMOVING FIBER AND TRASH WASTE ON OPEN-END SPINNING MACHINES

[75] Inventor: John Harrap, Prestbury, England

[73] Assignee: Parks-Cramer (Great Britain), Ltd., Oldham, England

[22] Filed: Sept. 30, 1975

[21] Appl. No.: 618,003

[52] U.S. Cl. ..... 57/56; 57/58.89; 57/156

[51] Int. Cl.[2] ..... D01H 1/12; D01G 9/12; D01H 11/00

[58] Field of Search ..... 57/34 R, 56, 58.89–58.95, 57/156; 15/301, 306 A

[56] References Cited

UNITED STATES PATENTS

| | | | |
|---|---|---|---|
| 3,627,584 | 12/1971 | Stewart et al. | 57/58.95 X |
| 3,763,641 | 10/1973 | Doudlebsky et al. | 57/56 |
| 3,774,382 | 11/1973 | Bartling | 57/56 X |
| 3,777,329 | 12/1973 | Lane | 15/301 |
| 3,777,466 | 12/1973 | Kabele et al. | 57/58.89 |
| 3,792,576 | 2/1974 | Doudlebsky et al. | 57/56 |
| 3,797,218 | 3/1974 | Landwehrkamp et al. | 57/58.89 |
| 3,826,071 | 7/1974 | Grau | 57/56 |
| 3,884,028 | 5/1975 | Stahlecker et al. | 57/56 |

*Primary Examiner*—Donald E. Watkins
*Attorney, Agent, or Firm*—Bell, Seltzer, Park & Gibson

[57] ABSTRACT

A method and apparatus of spinning yarns on an open-end spinning machine having a plurality of spinning positions, in which trash waste separated from the fibers of the slivers during advancement through respective fiber opening zones to respective yarn spinning rotors is continuously removed from the opening zones by a low velocity suction current of air and pneumatically conveyed along respective passageways to a central waste collection zone. In order to prevent accumulation of trash in the passageways and possible blockage thereby, the passageways are periodically purged by momentarily increasing the flow of air therealong to create a predetermined relatively high velocity in the passageways. A common source of suction may be employed for removal of the trash waste from the opening zones and also for removal of fiber waste from the respective yarn spinning rotors of the machines.

29 Claims, 10 Drawing Figures

10
11
12
13
14
15
16
17
20
22
24
26
39
G-1
G-2
G-3
G-4
G-5

PRIMARY FILTER UNIT
10
11
12
13
14
15
16
17
20
22
24
25
26
30
39
40
43
G-1
G-2
G-3
G-4,5

METHOD AND APPARATUS FOR PNEUMATICALLY REMOVING FIBER AND TRASH WASTE ON OPEN-END SPINNING MACHINES

This invention relates to open-end spinning, and in particular, to the removal and collection of trash waste separated from the fibers being spun incident to the spinning operation.

As a sliver advances through a spinning position of an open-end spinning machine, it passes first through an opener or beater section where it is subjected to the action of a rotating toothed roll and opened up into individual fibers. The opened fibers are thereafter advanced from the opener section to a spinning rotor to be spun into a yarn while the heavier trash waste is liberated from the fibers and cast centrifugally outwardly through a trash removal passageway provided in the opener section. The trash waste accumulates in a trash collection chamber located adjacent to the trash removal passageway and is conventionally removed either by hand or pneumatically.

In accordance with one well-known method of pneumatically removing trash waste from the respective spinning positions, the trash collection chambers are emptied from time to time by intermittent connection to a source of suction. For example, as disclosed in Lane U.S. Pat. No. 3,777,329 and Clayton U.S. Pat. No. 3,839,764, an endless moving belt is employed to successively connect and then disconnect each trash collection chamber with the source of suction.

Several problems have been noted with this system. For example, the endless belts wear out over a period of time and are costly to replace or repair. Also, it is necessary to maintain proper alignment of the belt and associated parts for proper connection and disconnection of the respective trash collection chambers with the source of suction. Also, the trash collection chamber requires frequent emptying, particularly when the sliver contains a relatively large amount of trash. If emptying is not carried out at sufficiently frequent and regular intervals, the suction to the trash collection chambers drops and excessive amounts of trash may accumulate and be drawn back into the opening zone and cause ends down.

Additionally, it has been determined that periodic application of suction to the trash collection chambers may undesirably affect yarn being produced by withdrawing usable fibers from the opening zone and conveying the same way along with the removed trash waste resulting in a waste of spinnable fibers as well as periodic variations in the yarn. With this problem in mind, several patents have proposed applying suction to the trash collection chamber only after first isolating the trash collection chamber from the fiber opening zone. For example Landwehrkamp et al. U.S. Pat. No. 3,797,218 discloses blocking the trash discharge opening communicating with the trash collection chamber, as by closing a door. Stahlecker et al. U.S. Pat. No. 3,884,028 provides a revolving door between the fiber opening zone and the trash collection chamber to mechanically convey trash waste from the fiber opening zone to a collection area while isolating the suction applied to the collection area from the fiber opening zone. Both of these approaches require that each spinning position on the open-end spinning machine be provided with moving parts which are subject to wear and periodic adjustment. Further, both of these systems must be incorporated in the spinning machine as originally designed and would not be suitable for later installation on existing open-end spinning machines.

Other prior patents disclosing the use of suction for removal of trash waste include Kabele et al. U.S. Pat. No. 3,777,466 and Doudlebsky et al. U.S. Pat. No. 3,763,641.

In commonly assigned copending U.S. application Ser. No. 485,773, filed July 5, 1974 a method and apparatus is disclosed wherein a source of suction is provided in continuous communication with respective trash collection chambers of an open-end spinning machine for continuously removing the trash waste therefrom. In accordance with this disclosure, the suction flow of air at each collection chamber is preferably maintained at a relatively low velocity which is sufficient to carry away the removed trash but which avoids the undesired removal of spinnable fibers from the opening zone. This arrangement eliminates the need for complicated mechanical gates, doors and the like at each spinning position, as noted above.

While this arrangement is entirely suitable in many instances, there are some applications, particularly where the sliver being fed to the spinning positions contains large amounts of trash, where the relatively low velocity suction flow of air is insufficient to completely convey away all of the trash being liberated from the fibers. In such instances, there is the possibility that the relatively narrow and often convoluted passageways which lead from the trash collection chambers to a suction duct may become partially or completely clogged by accumulated trash waste.

With the foregoing in mind, it is a primary object of this invention to provide a method and apparatus for continuously removing trash waste from the respective spinning positions of an open-end spinning machine by suction while insuring against trash accumulation or blockages in the trash conveying passageways.

In accordance with this invention, trash waste is continuously removed from the respective trash collection chambers of the open-end spinning machine by a relatively low velocity suction flow of air and conveyed along respective passageways to a waste collection zone. At periodic intervals, the respective passageways are purged of any accumulated trash by providing a momentary relatively high velocity flow of air in the passageways. This periodic purging of the passageways with a high velocity air flow thus serves as an "insurance" against blockage of the passageways.

This invention may be suitably applied to new as well as to existing open-end spinning machines without requiring extensive modifications thereto and without the need for troublesome mechanical moving parts at each spinning position.

In accordance with the invention a source of suction is provided in constant communication with the respective trash collection chambers of the machine. The suction air flow along the respective passageways communicating with the trash collection chambers is normally maintained at a relatively low velocity by imposing a predetermined restriction to the suction air flow. The passageways are periodically purged of any accumulated trash waste by momentarily eliminating the restriction to air flow to thereby periodically create a predetermined relatively high velocity in the passageways.

The aforementioned commonly assigned copending U.S. application Ser. No. 485,773 also discloses a method and apparatus wherein a source of suction is employed for effecting an air flow past the respective spinning rotors of an open-end spinning machine for the spinning operation and to remove fiber waste from the rotors, and wherein the same source of suction is employed for continuously removing from the trash collection chambers trash waste liberated from the fibers in the opening zone during their travel to the respective rotors.

It is a further object of the present invention to provide a method and apparatus wherein a common source of suction may be employed to provide for fiber waste removal at the rotors and for continuous trash waste removal at the opening zone, as above, and in addition for effecting periodic purging of the trash removal passageways communicating with the trash collection chambers of the respective spinning positions.

Groups of machines may be suitably interconnected pursuant to a further aspect of this invention and served by a common source of suction for providing both rotor air flow and fiber waste removal at the rotors, as well as for providing trash waste removal at the opening zones. Normally, in such installations, it is desirable to effect purging of the machines of the group sequentially, one machine at a time.

The invention is applicable to open-end spinning machines of the single-sided type wherein all of the respective spinning positions thereof are provided along a single side of the machine, and is also applicable to spinning machines of the double-sided type wherein spinning positions are provided along both sides of the spinning machine.

Some of the principal objects and features of the invention having been generally described, further objects and advantages will become apparent from the following detailed description of preferred embodiments of the invention, when taken in connection with the accompanying drawings, in which FIG. 1 is a perspective view showing an open-end spinning machine having a plurality of spinning positions along one side thereof, and wherein the machine is provided with a pneumatic waste removal system in accordance with the invention;

Figures 7, 7A:
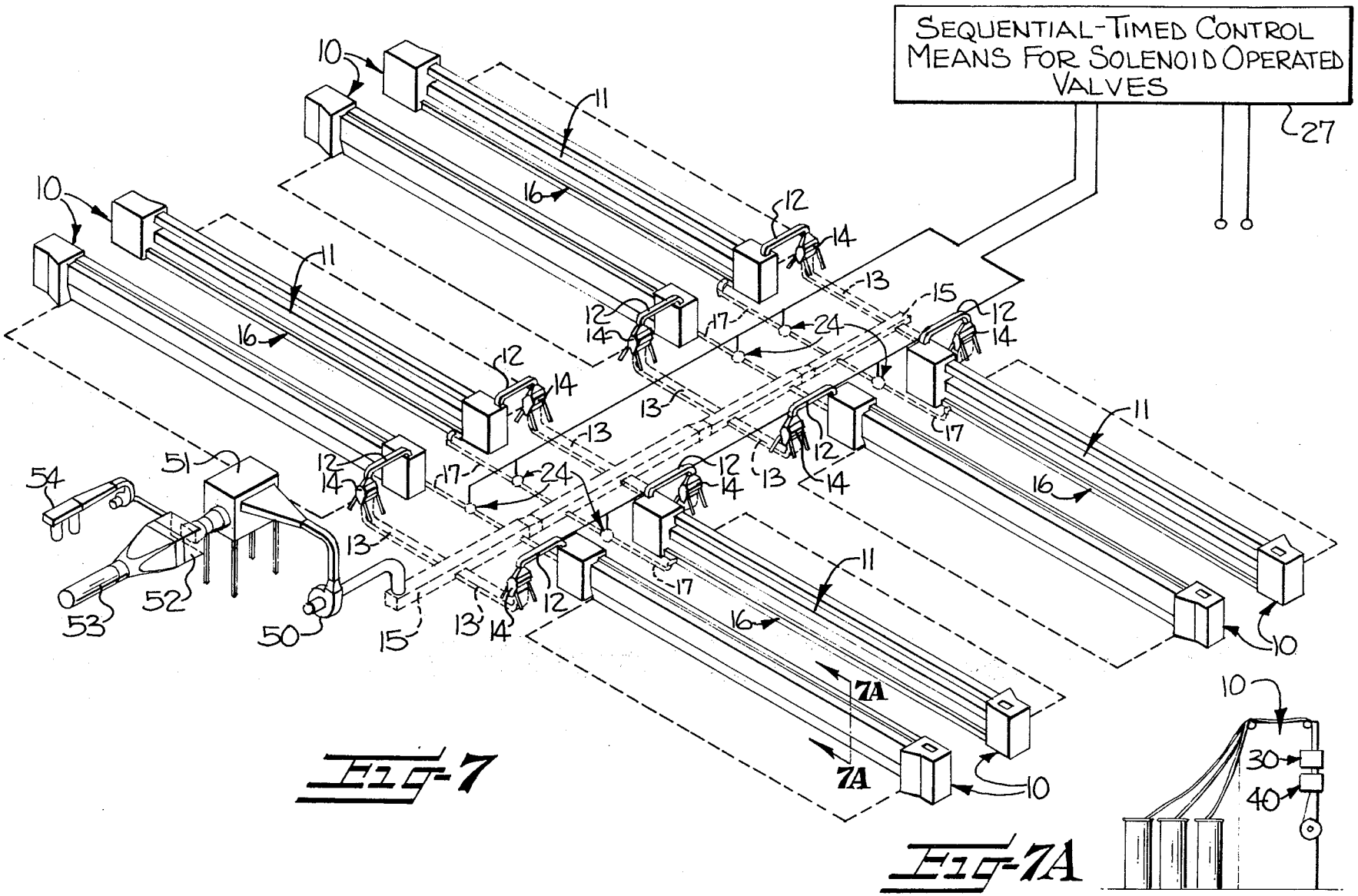
FIG. 7 is a schematic perspective view showing a typical installation of a plurality of open-end spinning machines having spinning positions along one side thereof, and which are provided with the improved pneumatic waste removing system of the present invention.
Figures 8, 8A:
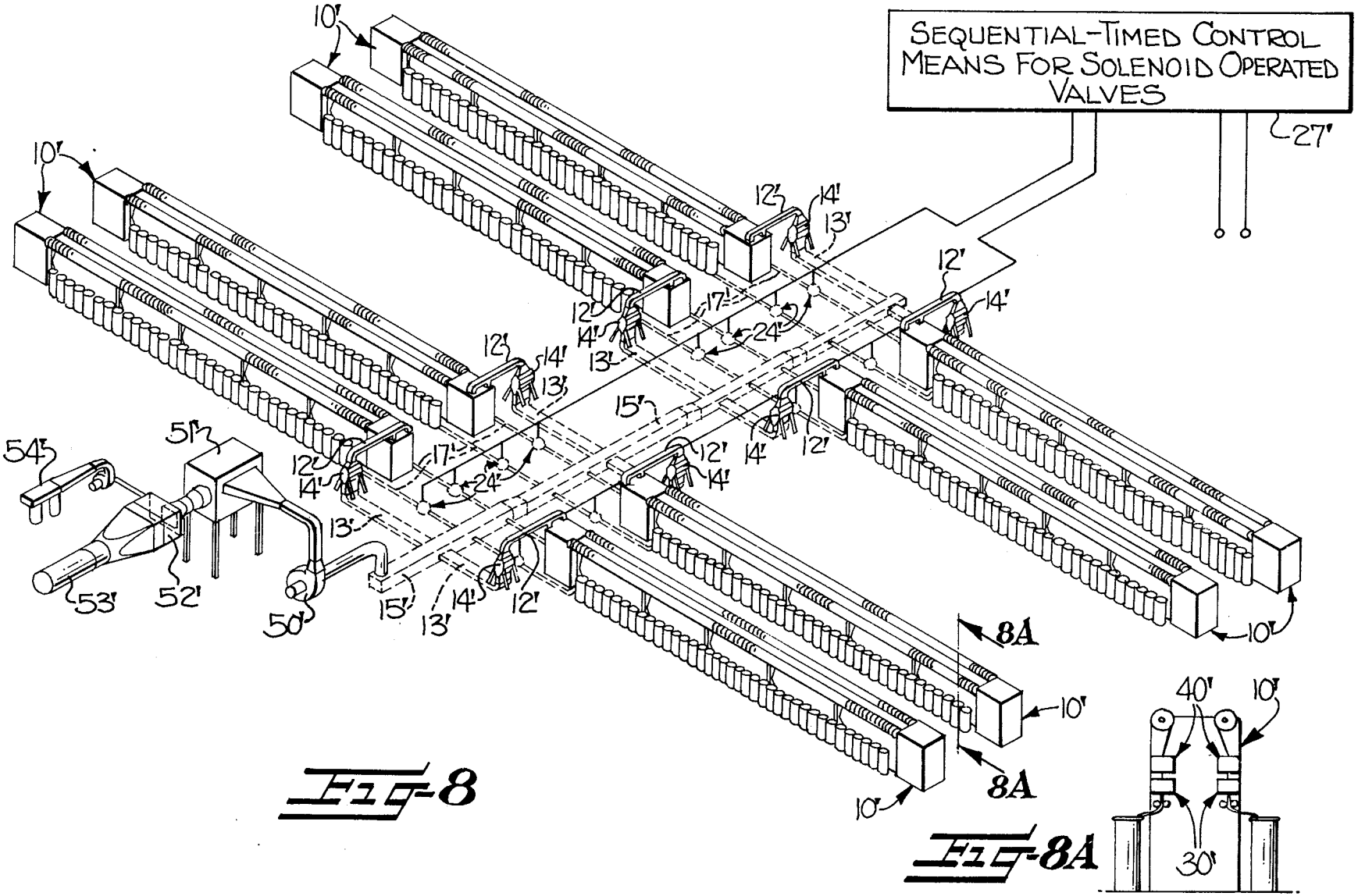

FIG. 7*a* is a schematic cross-sectional view of one of the machines of FIG. 7, taken substantially along the line 7*a*—7*a*, illustrating how the spinning positions are located along one side of the machine and the sliver supply cans are located along the opposite side thereof;

FIG. 8 is a schematic perspective view showing a typical installation of a plurality of open-end spinning machines having spinning positions along both sides thereof, and which are provided with the improved pneumatic removal system of the present invention; and FIG. 8*a* is a schematic cross-sectional view of one of the machines of FIG. 8, taken substantially along the line 8*a*—8*a*, illustrating how the spinning positions are located along both sides of the machine with the associated sliver supply cans being positioned adjacent thereto.

Figure 1:
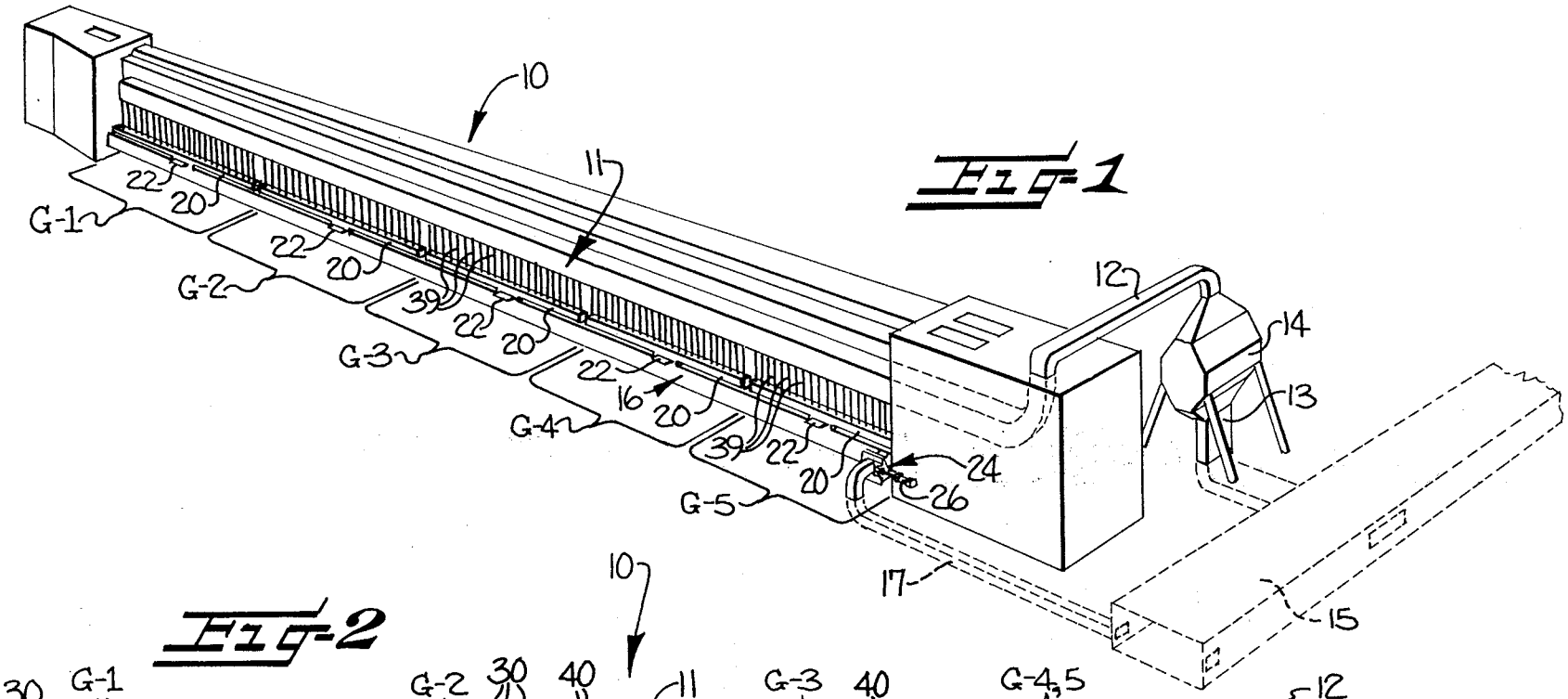
Figure 2:
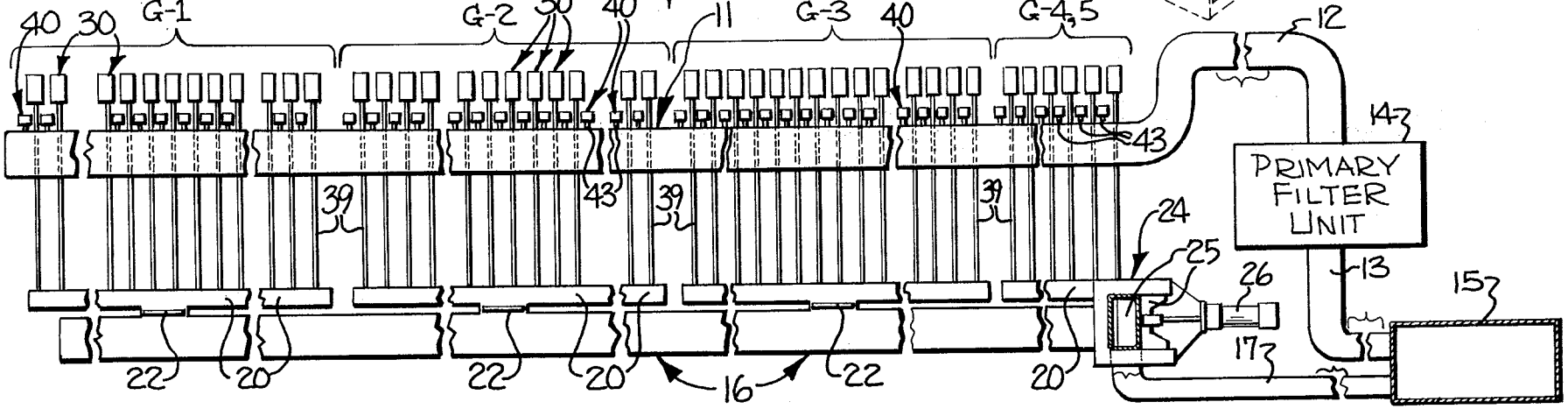
FIG. 2 is a schematic view of an open-end spinning machine similar to FIG. 1 showing in greater detail the arrangement of the pneumatic waste removal system of the invention.

Referring now more particularly to the drawings, FIG. 1 shows the exterior of a conventional open-end spinning machine 10 having a plurality of spinning positions along the length thereof, all facing a common side of the machine. The machine illustrated has 100 spinning positions arranged in five groups, G1 to G5, with twenty side-by-side spinning positions in each group. As can be seen from FIGS. 1 and 2, a rotor suction duct 11 extending the length of the machine is communicatively connected to the spinning rotor at each spinning position of the machine for effecting a high velocity air flow through each rotor and rotor chamber, as will be later described. At one end of the machine, the rotor suction duct is connected by suitable connecting ducts 12, 13 through a primary filter unit 14 and to a main suction duct 15, which in turn is connected to a primary source of suction, not illustrated.

A beater suction duct 16 also extends the length of the machine for providing suction to the respective spinning positions therealong for removal of trash waste, as will be later described in more detail. The beater suction duct 16 is connected by a connecting duct 17 to the main suction duct 15. The connecting ducts 17 and 13, and the main duct 15 are shown in broken lines in FIGS. 1 and 7 to indicate that they may be suitably hidden in or under the floor of the spinning room, if desired.

Overlying the beater suction duct 16 along the length of the machine is a plurality of beater suction manifolds 20, one for each of the five groups G1 to G5 of spinning positions. Each manifold 20 is communicatively connected to the beater suction duct 16, and in turn, to the respective trash receptacles or collection chambers of the spinning positions in that group.

The open-end spinning unit of each spinning position may be of the type as generally disclosed in the earlier mentioned Lane U.S. Pat. No. 3,777,329. One of such spinning units is shown in detail in FIG. 3 and consists of two basic sections or zones, an opening zone or section, generally indicated at 30, also sometimes referred to as a beater section, and a rotor section, generally indicated at 40. The opening section 30 receives a fibrous strand S in the form of a sliver, separates and opens the same into its constituent fibers, and directs the separated fibers to the rotor section 40 where the fibers are spun into a yarn Y.

Rotor section 40 includes a spinning rotor element 41, sometimes referred to as a "spinning chamber", which is suitably driven to rotate at a high speed within a rotor chamber 42 and to which one end of a suction tube 43 is communicatively connected. The opposite end tube 43 is connected to the rotor suction duct 11 for thereby effecting high velocity air flow through each rotor chamber and for carrying away any waste fibers resulting from the spinning operation. The yarn Y formed of the fibers by the spinning rotor element 41 may be withdrawn from the rotor section 40 by suitable driven rolls R.

The opening section 30 includes a rotating opener or beater roll 31 disposed within a relatively closely confining beater chamber 32 defined by a housing 33. The fibrous strand or sliver S is fed to the opener roll 31 by a rotating feed roll 34 cooperating in a conventional manner with a feed plate 35. The term "sliver" is used herein to mean a strand of untwisted, loosely connected fibers which may be readily opened or separated in its path of travel to the respective rotor.

The fibers, after being opened-up by opener roll 31, are conveyed by the high velocity current of air along a passagway or duct 36 and are directed to rotor section 40. As is conventional, each opener roll 31 is provided with peripheral teeth, needles or other projections thereon for combing out and separating or opening the sliver as it is moved in a predetermined path of travel partially defined by the gap between the opener roll 31 and the inner wall of the housing 33 defining chamber 32. Thus, the fibers being directed to each rotor travel along an arcuate path which changes directions so that as the fibers move past a trash removal aperture or discharge opening 37 provided in housing 33, trash waste is liberated and thrown out from the fibers by centrifugal force, and discharged through the removal aperture 37 into a respective trash receptacle or collection chamber 38.

The path along which the fibers travel in their course to each rotor may be defined by means other than the periphery of the opener roll 31 and the wall of the housing 33 which defines chamber 32, just so long as the fibers are opened or separated and the trash waste is liberated therefrom before the fibers are drawn into the yarn spinning rotor by high velocity suction air flow. For example, such path of travel of the fibers may be defined by any suitable duct means or tube means so arranged as to produce a change of direction of movement of the fibers such as to throw out trash waste from the fibers through a trash discharge opening adjacent the zone of the change of direction of such path of travel as disclosed, for example, in FIGS. 5, 6, 12 and 13 of Landwehrkamp et al. U.S. Pat. No. 3,797,218.

One end of a small diameter trash conveying suction tube 39 is communicatively connected to the lower portion or wall of each trash collection chamber 38 in each group of spinning positions, the other end being communicatively connected to the respective beater suction manifold 20 for that group of spinning positions. Thus, each trash conveying suction tube 39 defines a trash conveying passageway for withdrawing the trash from the collection chambers 38 and conveying the same to the respective beater suction manifolds 20 and thereafter to the beater suction duct 16. Because of the configuration of the spinning machine, the trash conveying suction tubes 39 are of small diameter and conventionally have several bends or turns therein and thus the passageways defined by the tubes 39 are normally rather narrow and convoluted.

Preferably, the suction air flow applied to each trash collection chamber 38 is normally maintained at a relatively low velocity so as to remove the trash waste from each trash colection chamber without withdrawing usable fibers from the opening zone and without interfering with the operation of the respective spinning rotors. In this regard, it will be observed in FIG. 3 that the trash collection chamber 38 is provided with one or more air ingress openings 38*a*. Openings 38*a* are preferably located remote from the opener roller and are shown in the form of louvered openings through the upper portion of an outer side wall of the respective trash collection chamber 38.

Figures 3, 4, 5, 6:
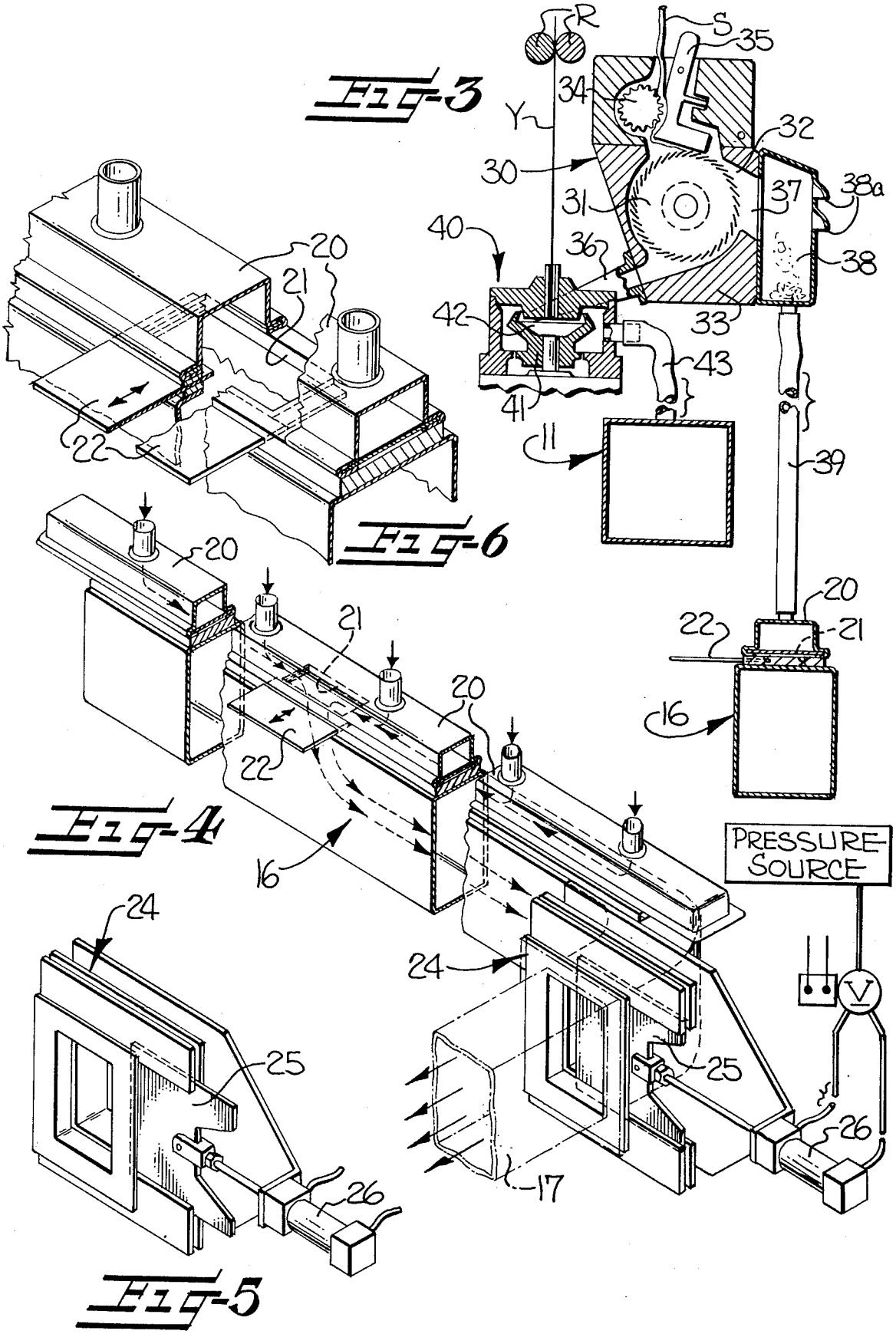
FIG. 3 is a schematic elevational view, largely in cross section, of a typical spinning unit of an open-end spinning machine from which rotor fiber waste and beater trash waste are pneumatically removed in accordance with the invention.
FIG. 4 is a fragmentary schematic perspective view showing a portion of the suction duct employed for pneumatically removing trash waste from the spinning positions and also showing the associated valve in a restricted position for minimum air flow through the duct.
FIG. 5 is a detailed schematic perspective view of the valve of FIG. 4 shown in a less restricted position for maximum air flow during purging.
FIG. 6 is a detailed fragmentary perspective view of the suction duct of FIG. 4 showing the overlying suction manifold and the cooperating manually adjustable restrictor means.

To facilitate balancing the suction air flow along the length of the machine so that the flow achieved at the respective trash collection chambers is substantially equal along the length of the machine and not unduly high at the end closest to the source of suction, means is preferably provided associated with each of the respective beater suction manifolds 20 for effecting a variance in the respective amounts of air flowing therethrough. This may be suitably accomplished by tapering the duct 16, or preferably, and as illustrated, varying the size of the opening 21 from the beater suction duct to the respective beater suction manifolds. As illustrated in FIG. 6, a manually adjustable sliding gate valve in the form of a plate 22 is provided at the opening 21 from each manifold 20 to the beater suction duct 16. Other suitable means for accomplishing this purpose will be readily apparent. For example, instead of a sliding valve, interchangeable orifice plates of various fixed sizes may be employed. Obviously, the manifold at the end of the duct closest to the source of suction will require a more restricted opening then the manifold at the far end of the duct remote from the source of suction.

As noted earlier, the air flow along the respective trash conveying suction tubes 39 is normally maintained at a relatively low velocity to avoid the withdrawal of usable fibers from the opening section 30. This air flow is sufficient in itself to keep the trash collection chambers 38 clear. However, in order to insure that the narrow passageways defined by the trash conveying suction tubes 39 remain clear of any obstruction, as might occur, for example from accumulation of trash waste where the narrow passageway curves or changes direction, it has been found desirable to periodically purge the respective passageways of any accumulated trash by momentarily increasing the flow of air to create a predetermined relatively high velocity in the passageways. Normally, it is preferred that the intensity and duration of the increased flow of air along the respective passageways be controlled so that the increased suction is inadequate for appreciably removing spinnable fibers from the opening zone. When spinning coarse counts or other yarns where periodic variation in yarn size is not important, however, the purging may be of such intensity and duration as to remove appreciable fibers from the opening zone.

Referring again to FIG. 2, it will be observed that the beater suction duct 16 and the rotor suction duct 11 of the machine are both connected to a common source of suction by the main duct 15. The negative pressure created in main duct 15 by the operation of the central suction device is relatively high in order to provide the needed high velocity air flow from respective spinning rotors of the machine. This air velocity is much higher than that desired for removing trash from each trash collection chamber. Therefore, in order to achieve a relatively low velocity air flow at the trash collection chambers, a restriction is provided in the flow passageway along the beater suction duct. As illustrated, this restriction takes the form of a sliding gate valve 24. Valve 24 includes a sliding damper plate 25 and a suitable valve actuator 26 of the well known pneumatic, hydraulic or solenoid operated type.

In its normal position as illustrated in FIG. 4, plate 25 extends across a substantial portion of the cross sectional area of the opening in duct 16 and provides a predetermined maximum restriction to air flow so that the air velocity upstream in the respective trash conveying suction tubes is at a predetermined minimum velocity. Periodically, the valve is opened momentarily to a predetermined less restricted position as illustrated in FIG. 5 to momentarily permit the relatively high suction in duct 15 to create a relatively high velocity in the respective passageways to thereby purge the passageways of any accumulated trash. Preferably, as illustrated, the respective spinning positions along one side of the machine are all connected to the same duct 16, and it will be appreciated that the purging of the respective passageways is thus performed simultaneously at all of the spinning positions along the same side of the machine.

The actual air velocities and pressures employed, as well as the frequency and duration of purging, depends to a large extent on the construction and other peculiar characteristics of the particular open-end spinning machine employed, as well as the amount of trash in the fibers being spun. Generally speaking, the purging is preferably performed at predetermined intervals of uniform duration, normally for durations of up to about six seconds, and most desirably for about two seconds. The intervals between purging preferably range from about one minute to about fifteen minutes.

By way of example, in one installation where the available suction of negative pressure at the beater suction duct was about 30 inches of water gauge pressure, the flow of air to the trash collection chambers was restricted by an adjustable gate valve to a level of about 3 to 3.5 c.f.m. during normal operation. The valve was opened for two seconds every 15 minutes to apply the 30 inch W.G. pressure to the end of the beater suction duct. Because of the tortuous path of the tubes to each trash collection chamber and the very small bores thereof, the resistance to air flow resulted in a momentary maximum static pressure measured at connection to the trash collection chamber of about 10 inches water gauge pressure.

FIG. 7 illustrates a typical installation of a group of single-sided open-end spinning machines 10 of the type illustrated in FIG. 1. The area enclosed by broken lines alongside each machine 10 represents the location of a plurality of supply cans of sliver which is to be spun into yarns by the spinning machine, as can be seen more clearly from FIG. *7a.*

Eight machines 10 are illustrated, arranged in two rows with the main suction duct 15 extending between the two rows and adjacent to one end of each of the machines. The rotor suction duct of each machine is connected by connecting ducts 12, 13 through a respective primary filter unit 14 and to the main duct 15. Thus, a primary source of suction associated with main duct 15 serves to induce a high velocity air flow through each rotor of all of the spinning machines in the group. The primary filter unit 14 for each machine serves to arrest air-entrained fiber waste produced incident to the spinning operation to facilitate collection of such waste. Each such primary filter unit 14 may be constructed and operated in substantially the same manner as the primary filter units disclosed in commonly assigned copending U.S. applications Ser. No. 409,055, filed Oct. 24, 1973 and Ser. No. 485,773, filed July 5, 1974, to which applications reference may be made for a further understanding of the primary filter.

The respective beater suction ducts of each machine of the group are also communicatively connected to the main duct 15 by a connecting duct 17 so that the trash collection chambers of all of the spinning machines in the group are pneumatically emptied by the primary suction source. A cooperating valve 24 is associated with each duct 17 for providing an adjustable restriction in the flow passageway thereof to permit periodically purging the respective trash removal passageways of each spinning machine in the manner previously described. As illustrated, the valve 24 associated with each machine is connected by suitable wiring to a common control timer 27 which controls the periodic purging of all of the machines of the group.

The control timer 27 preferably operates in such a manner that the respective valves 24 are momentarily opened one machine at a time. Sequentially, the timer opens for a predetermined duration of time, one valve and then another until all of the machines 10 have been purged. Once an entire purging cycle has been completed, the valves 24 of all the machines remain in the normal restricted position until a predetermined interval of time has passed, and then another purging cycle is initiated. The interval between purging cycles, as well as the duration or length of time the valves 24 are maintained in the less restricted or open position, may be adjustably selected on the control timer 27. The control components and circuitry for accomplishing an adjustable sequential timing cycle of the type performed by control timer 27, as just described, as well known and may be readily obtained by those skilled in the art. Accordingly, a more detailed description of the control timer 27 is deemed unnecessary.

It is preferred that the machines of the group be purged sequentially rather than simultaneously in order that the pressure in main duct 15 will not be appreciably affected or reduced. Noticeable fluctuations or reductions of the pressure along duct 15 could alter the velocity of the air being drawn through the spinning rotors of the machines and might have an adverse affect on the uniformity of the yarns being spun or on the operability of the spinning machines.

The suction pressure in duct 15 is normally maintained at a relatively high level (for example, on the order of about 30 to 32 inches of water gauge pressure) in order to achieve the needed high velocities and flow rates at the spinning rotors of the machines. At these high flow rates and pressures, the amount of air drawn into duct 15 from the beater duct of a single machine during the momentary purging of the machine is not really significant so as to cause a noticeable fluctuation in the static pressure within main duct 15.

In the illustrated embodiment of the invention, the suction air flow is induced in the main duct 15 by a suitably driven fan means, such as the centrifugal blower 50 illustrated. The exhaust side of the blower 50 is communicatively connected to the inlet of a secondary filter box 51 which serves as a central waste collection zone for collecting both the fiber waste and the trash waste removed from all of the open-end spinning machines 10 of the group. Filter box 51 may be constructed and operated in substantially the same manner as the filter box 80 disclosed in commonly assigned copending U.S. application Ser. No. 485,773, filed July 5, 1974, the disclosure of which is incorporated herein by reference.

Any fine dust or fly which may penetrate the filter box 51 is discharged from one end portion of the filter box, through a suitable fine-dust filter 52, and into an air circulating duct system 53. Duct system 53 may serve to distribute the air being discharged by the blower 50 back into the room within which the open-end spinning machines 10 are positioned. The fine-dust filter 52 may be of a type such as is disclosed in Sherrill U.S. Pat. No. 3,303,635 dated Feb. 14, 1967, for example, which filter is provided with a suitable suction nozzle means, not shown, for continuously cleaning the same. Such suction nozzle means is arranged to continuously remove and discharge the collected fine dust from filter 52 and into suitable removable filter bags 54 which may be arranged and constructed in substantially the manner described in U.S. Pat. No. 2,500,123, which issued on Mar. 7, 1950, to E. C. Gwaltney et al. Accordingly, a further disclosure of the fine dust filter 52, the means for keeping the same clean, and the filter bags 54 is deemed unnecessary.

FIG. 8 illustrates the application of the method and apparatus of the present invention to a group of open-end spinning machines of the double-sided type, wherein respective spinning positions are arranged along opposite sides of each machine. As illustrated, in such machines the sliver supply cans are located along both sides of each machine adjacent to the corresponding spinning positions. Basically, such a system is constructed and operated in essentially the same manner as has been previously described with respect to single-sided open-end spinning machines. Accordingly, to avoid repetitive description, elements corresponding to those previously described with respect to the embodiment of FIG. 7 are identified with corresponding reference numerals, with prime notation added where applicable, and only the differences in construction and operation will be described herein in detail.

While not readily apparent from the drawings, the double-sided open-end spinning machines 10′ illustrated have respective rotor suction ducts and beater suction ducts serving each side of the machine. Thus it will be seen that the connecting duct 12′ from the top of each machine 10′ to the primary filter 14′ has branches leading to the rotor suction ducts on both sides of the machine. Similarly, it will be seen that a pair of connecting ducts 17′ extend from each machine 10′, one connecting duct 17′ serving the beater suction duct on each side of the machine. Respective valves 24′ are provided in association with each of the connecting ducts 17′. Thus it will be seen that the fundamental operation of each of the double-sided machines 10′ may be viewed, in effect, as being similar to a pair of single-sided machines connected together back-to-back.

Preferably, the control timer 27′ operates so as to purge one entire side of a machine at a time rather than purging all or several of the machines simultaneously. This avoids appreciably affecting the pressure in main duct 15′ as noted above with respect to the single-sided machines. The order of purging the machines is not critical. Thus, opposite sides of each machine may be separately purged before proceeding to purge the next adjacent machine, common sides of each machine in the group may be purged before purging the opposite sides thereof, or any other sequence may be employed so long as both sides of all of the machines are ultimately purged at predetermined intervals.

In some instances, particularly where smaller machines are employed having a relatively low number of spinning positions, it may be desirable or practical to purge both sides of a single machine simultaneously. Similarly, in spinning machines of certain constructions where a common beater suction duct serves both sides of the machine, both sides of the machine would be purged simultaneously. However, it is still preferred that the machines be purged sequentially, one at a time, in order to avoid causing fluctuations in the high velocity rotor air, as previously noted.

It is possible to purge all of the machine of a group simultaneously without substantially adversely affecting the rotor suction air by employing a suction blower of sufficiently high rating. However, since such a suction blower would be rated to meet the momentary peak demands during purging, it would be much larger than necessary to effect the needed continuous high velocity rotor air flow. It is much more practical and economical to employ a lower rated suction blower and to effect sequential purging of the machines.

In the drawings and specification, there have been set forth preferred embodiments of the invention, and although specific terms are employed, they are used in a generic and descriptive sense only and not for purposes of limitation.

That which is claimed is:

1. In a method of spinning yarns on an open-end spinning machine having a plurality of spinning positions along at least one side thereof, wherein at the respective spinning positions fibers are advanced through respective opening zones to respective spinning rotors while trash waste is liberated from the fibers during advancement through the respective opening zones to the spinning rotors, the improvement comprising continuously removing the liberated trash waste from the respective spinning positions by a relatively low velocity suction flow of air while conveying the trash waste along respective passageways and to a remote waste collection zone and while periodically and simultaneously purging the respective passageways on at least one side of the machine of any accumulated trash waste by momentarily increasing the flow of air to create a predetermined relatively high velocity in the passageways.

2. A method according to claim 1 wherein the open-end spinning machine has a plurality of spinning positions along both sides thereof and wherein the purging of the respective passageways by momentarily increasing the flow of air is performed simultaneously at all of the spinning positions along both sides of the machine.

3. A method according to claim 1 wherein the open-end spinning machine has a plurality of spinning positions along both sides thereof and wherein the purging of the respective passageways by momentarily increasing the flow of air is performed simultaneously at all of the spinning positions along one side of the machine at a time.

4. A method according to claim 1 wherein the intensity and duration of the increased flow of air along the respective passageways avoids any appreciable removal of spinnable fibers from the opening zone to thereby avoid creating periodic variations in the yarn.

5. In a method of spinning yarns on an open-end spinning machine having a plurality of spinning positions along at least one side thereof, wherein at the respective spinning positions fibers are advanced through respective opening zones to respective spinning rotors while trash waste is liberated from the opened fibers and deposited into respective trash receptacles during advancement of the fibers to the respective spinning rotors, the improvement comprising continuously removing the liberated trash waste from the respective trash receptacles by applying a relatively low velocity suction flow of air along respective passageways communicating with the trash receptacles, conveying the removed trash waste by said flow of air along the respective passageways and to a common waste collection zone, and periodically and simultaneously purging the respective passageways on at least one side of the machine of any accumulated trash waste by increasing the flow of air along the respective passageways at predetermined intervals of short duration to momentarily create a relatively high velocity therein.

6. A method according to claim 5 wherein the flow of air along the respective passageways is increased at predetermined intervals of uniform duration.

7. A method according to claim 5 wherein the flow of air along the respective passageways is increased at predetermined intervals and for a duration of no more than about six seconds.

8. A method according to claim 7 wherein the flow of air is increased for a duration of about two seconds.

9. In a method of spinning yarns on an open-end spinning machine having a plurality of spinning positions along at least one side thereof, each spinning position including a spinning rotor and an opening zone for opening fibers being advanced to the spinning rotor, and wherein a source of suction is employed to produce a primary air flow at the respective spinning rotors of the machine for removing fiber waste from the respective spinning rotors and for conveying the same to a waste collection zone, and the same source of suction produces a secondary air flow at the respective opening zones for removing trash waste liberated from the fibers during their travel through the respective opening zones to the respective rotors and for conveying the liberated trash waste along respective passageways and to the waste collection zone, the improvement comprising continuously removing the liberated trash waste by maintaining the secondary air flow in continuous communication with the respective spinning positions, while at periodic intervals, purging the passageways on at least one side of the machine of any accumulated trash waste by momentarily increasing the flow of air along the respective passageways to periodically create a predetermined relatively high velocity therein.

10. A method according to claim 9 wherein the open-end spinning machine has a plurality of spinning positions along both sides thereof and wherein the purging of the respective passageways by momentarily increasing the flow of air is performed simultaneously at all of the spinning positions along both sides of the machine.

11. A method according to claim 9 wherein the open-end spinning machine has a plurality of spinning positions along both sides thereof and wherein the purging of the respective passageways by momentarily increasing the flow of air is performed simultaneously at all of the spinning positions along one side of the machine at a time.

12. A method according to claim 9 wherein said step of momentarily increasing the flow of air along the respective passageways to periodically create a predetermined relatively high velocity therein comprises normally providing a predetermined restriction to air flow between the source of suction and the respective passageways and periodically eliminating the restriction to air flow momentarily so as to increase the flow of air and achieve said high velocity in the passageways.

13. In a method of spinning yarns on a group of open-end spinning machines, each machine having a plurality of spinning positions along at least one side thereof, and wherein at the respective spinning positions of each machine of the group, fibers are advanced through respective opening zones to respective spinning rotors while trash waste is liberated from the fibers during advancement through the respective opening zones to the spinning rotors, the improvement comprising continuously removing the liberated trash waste from the respective spinning positions of each machine of the group by a low velocity suction flow of air while conveying the trash waste from each spinning position along respective passageways and to a common waste collection zone and while periodically purging the passageways of each machine of any accumulated trash waste by momentarily increasing the flow of air along at least one side of each machine in the group, one machine at a time, to periodically create a predetermined relatively high velocity in the respective passageways thereof.

14. In a method of spinning yarns on a group of open-end spinning machines, each machine having a plurality of spinning positions along at least one side thereof, and wherein at the respective spinning positions of each machine of the group fibers are advanced through respective opening zones to respective spinning rotors while trash waste is liberated from the fibers during advancement through the respective opening zones and while fiber waste is produced at the respective spinning rotors incident to spinning, said method comprising producing a suction air flow along a duct leading to a central waste collection zone while directing the suction air flow from the duct along respective first passageways communicatively connected with the respective spinning rotors of each machine of the group and removing the fiber waste from the respective rotors with such air flow and conveying the same to the central waste collection zone, and while also directing the suction air flow from the duct along respective second passageways communicatively connected with the respective opening zones of each machine of the group and continuously removing the trash waste from each opening zone with such air flow and conveying the same along the second passageways and to the waste collection zone, the improvement comprising normally maintaining the suction air flow along the respective second passageways of each machine of the group at a predetermined relatively low velocity by imposing a predetermined restriction to the suction air flow, and periodically purging the respective second passageways of each machine of the group of any accumulated trash waste by momentarily eliminating the restriction to air flow along at least one side of each machine in the group, one machine at a time, to periodically create a predetermined relatively high velocity in the respective second passageways thereof.

15. In an open-end spinning machine having a plurality of spinning positions along at least one side thereof, each spinning position including a spinning rotor and an opening zone for opening fibers being advanced to the spinning rotor, and said opening zone having a trash removal aperture positioned for discharge therethrough of trash waste liberated from the opened fibers during their travel through the opening zone to the spinning rotor, and wherein means are provided defining respective passageways communicating with the respective trash removal apertures and extending therefrom and communicating with a remote trash collection zone, the improvement comprising means associated with said passageways for creating a suction flow of air therein for continuously removing the trash waste discharged through said trash removal apertures and for conveying the trash waste to said collection zone, and periodically actuable means associated with said passageways and operable for increasing the flow of air simultaneously in the passageways along at least one side of the machine to periodically create a predetermined relatively high velocity in the passageways to purge the same of any accumulated trash waste.

16. Apparatus according to claim 15 wherein the open-end spinning machine has a plurality of spinning positions along both sides thereof and wherein said periodically actuable means associated with said passageways is operable for momentarily increasing the flow of air simultaneously in the passageways of all of the respective spinning positions of the machine.

17. Apparatus according to claim 15 wherein the open-end spinning machine has a plurality of spinning positions along both sides thereof and wherein said periodically actuable means associated with said passageways is operable for momentarily increasing the flow of air simultaneously in the passageways along one side of the machine at a time.

18. Apparatus according to claim 14 wherein said periodically actuable means associated with said passageways is operable for increasing the flow of air at an intensity and for a duration avoiding any appreciable removal of spinnable fibers from the opening zone to thereby avoid creating periodic variations in the yarn.

19. Apparatus according to claim 14 wherein said periodically actuable means associated with said passageways is operable for increasing the flow of air at predetermined intervals of uniform duration.

20. Apparatus according to claim 14 wherein said periodically actuable means associated with said passageways is operable for increasing the flow of air at predetermined intervals and for a duration of no more than about six seconds.

21. Apparatus according to claim 20 wherein said periodically actuable means associated with said passageways is operable for increasing the flow of air for a duration of about two seconds.

22. In an open-end spinning machine having successive spinning positions located along at least one side thereof, each including a spinning rotor, an opening zone for opening fibers being advanced to the spinning rotor, and a trash receptacle positioned for receiving trash waste liberated from the opened fibers during their travel through the opening zone to the spinning rotor, and wherein the trash receptacles at the respective spinning positions along said one side of the machine are communicatively connected by respective narrow passageways to a common trash removal duct extending along the machine, the improvement comprising means associated with said trash removal duct for creating a suction flow of air therein and in said passageways for continuously removing trash waste from said trash receptacles, valve means associated with said trash removal duct and defining an adjustable restriction to the flow of air therethrough, and means cooperating with said valve means for normally positioning the valve means so as to restrict the flow of air to a predetermined relatively low velocity in said passageways, and for at times repositioning the valve means so as to momentarily permit a periodic relatively high velocity in the passageways to purge the same of any accumulated trash waste.

23. Apparatus according to claim 22 wherein the spinning positions along said one side thereof are arranged in groups with a plurality of spinning positions in each group, and wherein the respective narrow passageways connected to the spinning positions in each group are communicatively connected to respective manifolds, which in turn, are communicatively connected to said trash removal duct, the further improvement comprising means associated with the respective manifolds for effecting a variance in the respective amounts of air flowing therethrough for balancing the air flow along the length of the machine so that a substantially equal velocity flow of air is achieved at each group of spinning positions of the machine.

24. In an open-end spinning machine having a plurality of spinning positions along at least one side thereof and wherein at each spinning position fibers are advanced through an opening zone to a spinning rotor while trash waste is liberated from the fibers during advancement through the opening zone and while fiber waste is produced at the spinning rotor incident to spinning, and wherein a source of suction is employed to produce a primary air flow at the respective spinning rotors of the machine for removing the fiber waste from the respective spinning rotors and conveying the same to a waste collection zone, and the same source of suction produces a secondary air flow at the respective opening zones for removing the liberated trash waste and for conveying the same along respective passageways and to said waste collection zone, the improvement comprising means cooperating with said passageways for normally maintaining said secondary air flow at a predetermined relatively low velocity therealong to continuously remove the liberated trash waste from the respective opening zones, and for increasing the flow of air in the respective passageways along at least one side of the machine at periodic intervals of short duration to periodically create a predetermined relatively high velocity therein to purge the passageways of any accumulated trash waste and thereby avoid blockages thereof.

25. Apparatus according to claim 24 wherein the open-end spinning machine has a plurality of spinning positions along both sides thereof and wherein said means cooperating with said passageways is operable for increasing the flow of air simultaneously in the passageways of all of the respective spinning positions of the machine.

26. Apparatus according to claim 24 wherein the open-end spinning machine has a plurality of spinning positions along both sides thereof and wherein said means cooperating with said passageways is operable for increasing the flow of air simultaneously in the passageways along one side of the machine at a time,

27. In an apparatus for spinning yarns on a group of open-end spinning machines, each machine having a plurality of spinning positions along at least one side thereof, and wherein at each spinning position fibers are advanced through an opening zone to a spinning rotor while trash waste is liberated from the fibers during advancement through the opening zone and wherein a source of suction is employed to produce an air flow along respective passageways communicating with each opening zone of each machine of the group for removing the liberated trash waste from the respective opening zones and for conveying the trash waste along the respective passageways and to a waste collection zone, the improvement comprising means cooperating with each machine of the group for normally maintaining the suction air flow through the respective passageways thereof to the respective opening zones at a predetermined relatively low velocity to continuously remove the liberated trash waste from the respective opening zones, and for momentarily increasing the flow of air along at least one side of each machine of the group, one machine at a time, to periodically create a predetermined relatively high velocity in the respective passageways thereof to purge the passageways of any accumulated trash waste and thereby avoid blockages thereof.

28. In an apparatus for spinning yarns on a group of open-end spinning machines, each machine having a plurality of spinning positions along at least one side thereof, and wherein at each spinning position fibers are advanced through an opening zone to a spinning rotor while trash waste is liberated from the fibers during advancement through the opening zone and while fiber waste is produced at the spinning rotor incident to spinning, said apparatus comprising a duct leading to a central waste collection zone and having means associated therewith for producing a suction air flow along the duct, means defining respective first passageways communicatively connected with the duct and with the respective spinning rotors of each machine in the group for directing the suction air flow to the respective spinning rotors and removing waste fibers therefrom with such air flow, means defining respective second passageways communicatively connected with the duct and with the respective opening zones of each machine in the group for directing the suction air flow to the respective opening zones and continuously removing the liberated trash waste therefrom with such air flow, the improvement comprising restrictor means cooperating with each machine of the group for normally imposing a predetermined restriction to the suction air flow along the respective second passageways thereof so as to normally maintain the suction air flow in said second passageways at a predetermined relatively low velocity, and sid restrictor means being operable for momentarily eliminating the restriction to air flow along at least one side of each machine of the group, one machine at a time, to periodically create a predetermined relatively high velocit in the respective passageways of each machine to purge the passageways of any accumulated trash waste and thereby avoid blockages thereof.

29. Apparatus according to claim 28 wherein said restrictor means comprises respective valves cooperating with each machine of the group for adjustably restricting the suction air flow to the respective passageways thereof from said duct, each valve being adjustable between a first position imposing a predetermined restriction to the suction air flow to its respective machine, and a second position imposing less restriction to the suction air flow, and said restrictor means also comprising means cooperating with the respective valves for normally positioning the same in said first restricted position and for sequentially positioning the valves momentarily in said second less restricted position to thereby momentarily permit a relatively high suction in the respective passageways of the respective machines to purge the passageways of any accumulated trash.

* * * * *

UNITED STATES PATENT OFFICE
CERTIFICATE OF CORRECTION

PATENT NO. : 3,986,328
DATED : October 19, 1976
INVENTOR(S) : John Harrap

It is certified that error appears in the above-identified patent and that said Letters Patent are hereby corrected as shown below:

Column 1, Line 51, "way" should be --away--. Column 5, Line 8, after "end" insert --of--. Column 6, Line 7, "colection" should be --collection--. Column 7, Line 42, "of" should be --or--. Column 8, Line 43, second occurrence of "as" should be --are--. Column 16, Line 16, "sid" should be --said--; same Column, Line 20, CLAIM 28, "velocit" should be --velocity--.

Signed and Sealed this

Fourth Day of January 1977

[SEAL]

*Attest:*

RUTH C. MASON
*Attesting Officer*

C. MARSHALL DANN
*Commissioner of Patents and Trademarks*